US005192024A

United States Patent [19]

Blee

[11] Patent Number: 5,192,024

[45] Date of Patent: Mar. 9, 1993

[54] SPRINKLER

[76] Inventor: Leonard J. Blee, 66 Leslie Ave., Blair Athol, Australia, 5084

[21] Appl. No.: 760,404

[22] Filed: Sep. 16, 1991

[30] Foreign Application Priority Data

Sep. 17, 1990 [AU] Australia ..... PK 2371
Jun. 25, 1991 [AU] Australia ..... PK 6875

[51] Int. Cl.[5] ..... B05B 3/08

[52] U.S. Cl. ..... 239/222.21; 239/222.17; 239/381; 239/467; 239/DIG. 1

[58] Field of Search ..... 239/222.11, 222.17, 239/222.19, 222.21, 380, 381, 466, 467, DIG. 1

[56] References Cited

U.S. PATENT DOCUMENTS

| | | | |
|---|---|---|---|
| 177,630 | 5/1876 | Foster | 239/222.17 |
| 1,239,229 | 9/1917 | Shaw | 239/222.17 X |
| 1,880,880 | 10/1932 | Dietsch | 239/383 |
| 2,116,879 | 5/1938 | Day | 239/382 |
| 2,639,191 | 5/1953 | Hruby, Jr. | 239/222.17 X |
| 3,006,558 | 10/1961 | Jacobs | 239/222.17 X |
| 3,034,728 | 5/1962 | Hruby, Jr. | 239/222.17 X |
| 4,205,785 | 6/1980 | Stanley | 239/222.17 X |
| 4,331,294 | 5/1982 | Gilad | 239/222.17 |
| 4,583,689 | 4/1986 | Rosenberg | 239/381 |

*Primary Examiner*—Andres Kashnikow
*Assistant Examiner*—William Grant
*Attorney, Agent, or Firm*—Webb, Burden, Ziesenheim & Webb

[57] ABSTRACT

A sprinkler having a body with a smooth annular interior surface which converges in a downstream direction to a throat and then diverges to a generally conical depression, the interior surface being fair at the location of the throat to reduce turbulence, the water entering the throat being rotationally swirled by some swirl imparting surfaces upstream of the throat, and the depression containing an impeller which has a conical surface which lies contiguous with the conical surface of the depression, but the conical impeller surface is interrupted and contains discharge channels extending outwardly from near the center of the impeller.

14 Claims, 5 Drawing Sheets

SPRINKLER

BACKGROUND OF THE INVENTION

Field of the Invention

This invention relates to a sprinkler which is useful as an irrigation device for irrigating agricultural or horticultural areas, and seeks to provide a sprinkler which with simple changes, can be used for irrigating a small area or a large area.

Irrigation of small areas of course is well known and is achieved by any one of a wide range of available sprinklers. Irrigation of large areas is also well known, but a difficulty which has been encountered has been the disintegration of a coherent jet of water so that the throw from a sprinkler is limited. It is well recognised that to achieve a long throw it is necessary that the droplets should be relatively large and not in the form of a fine mist, the large droplets having a larger inertia compared with their surface area. Most irrigators which have been devised for use over large areas have sought to achieve this, and the most commonly used at the present time is the type wherein a nozzle discharges a coherent jet of water which however is intermittently intercepted by a deflector vane, and impact of the deflector vane causes rotation of the nozzle.

However such prior art devices utilise bearing surfaces where solid surfaces rub on solid surfaces, and therefore are subject to mechanical deterioration and also to malfunction in the case of solid particles being contained in the water which is used for irrigation purposes.

PRIOR ART

The prior art known to the applicant includes the following:

U.S. Pat. No. 4,331,294 Gilad
U.S. Pat. No. 4,583,689 Rosenberg
U.S. Pat. No. 2,639,191 Hruby
U.S. Pat. No. 2,116,879 Day
U.S. Pat. No. 1,880,880 Dietsch Of the above, the Gilad U.S. Pat. No. 4,331,294 appears to the applicant to be the most relevant prior art because it discloses embodiments wherein an impeller is not necessarily carried by a mechanical bearing but can be freely rotatable without necessarily having any rubbing surfaces. The next most relevant prior art known to the applicant is the abovementioned Rosenberg U.S. Pat. No. 4,583,689.

BRIEF SUMMARY OF THE INVENTION

With the object of providing an improved sprinkler wherein there are no rubbing surfaces and is capable of achieving a long throw with a coherent jet discharged from an impeller, this invention provides a sprinkler having a body with a smooth annular interior surface which converges in a downstream direction to a throat and then diverges to a generally conical depression, the interior surface being fair at the location of the throat to reduce turbulence, the water entering the throat being rotationally swirled by some swirl imparting surfaces upstream of the throat, and the depression containing an impeller which has a conical surface which lies contiguous with the conical surface of the depression, but the conical impeller surface is interrupted and contains discharge channels extending outwardly from near the center of the impeller.

With this arrangement, it is possible to achieve a very coherent jet of water which will not even commence to break up until it has discharged several meters from the sprinkler, and therefore can achieve a long throw. If the surfaces of the impeller and the conical depression are complementary to each other, then there is sufficient suction induced between those surfaces by the rapidly moving water that atmospheric pressure will retain the impeller centrally within the depression, but the surfaces will be separated by a minute film of water thereby avoiding solid to solid rubbing surfaces and in turn reducing the likelihood of damage due to wear, or malfunction due to particulate material contained in the water.

It is a characteristic of the construction of a sprinkler according to this invention that when water is first applied, the pressure of water discharging and the deflection of that discharging water by the conical surface will lift the impeller away from the impeller conical surface of the depression and this provides a very effective self cleaning facility which is particularly useful if the construction is modified for irrigating small areas or microirrigation. In the event of long throw being required, the channels can be so displaced from radial direction as to impart a torque which will tend to rotate the impeller in a direction which can be opposite the swirl of water in the depression at the discharge end of the body. This being the case, the rotational speed can be adjusted by simple variation of the configuration of channels, and if adjusted to be very slow, then the maximum possible throw can be achieved. There appears to be very little loss due to the change of direction of swirling water into a discharge stream. Most suitably, there would be three circumferentially spaced channels for discharging for long throw purposes.

However an oscillatory condition can be achieved if there are only two discharge channels which discharge at approximately 180° from each other from the impeller.

More specifically, the invention consists of a sprinkler useful as an irrigation device comprising a body containing an annular surface extending from an upstream end to a discharge end, including a throat intermediate the ends, a generally conical depression diverging from the throat to the discharge end, fair surfaces in the region of the throat, swirl imparting surfaces at the upstream end of the generally conical portion, and an impeller in the conical depression having a generally conical surface diverging in a discharge direction and substantially complementary in shape to the conical depression, so that, in use, most of the impeller surface lies contiguous with the conical depression surface, the impeller conical surface containing surfaces defining a plurality of discharge channels extending outwardly from near its center, said channel surfaces being of size and shape to be co-operable with the conical depression surface to confine water when discharging into respective coherent water jets.

BRIEF SUMMARY OF THE DRAWINGS

Embodiments of the invention are described in some detail with reference to and are illustrated in the accompanying drawings in which.

DESCRIPTION OF THE PREFERRED EMBODIMENTS

Figure 1:
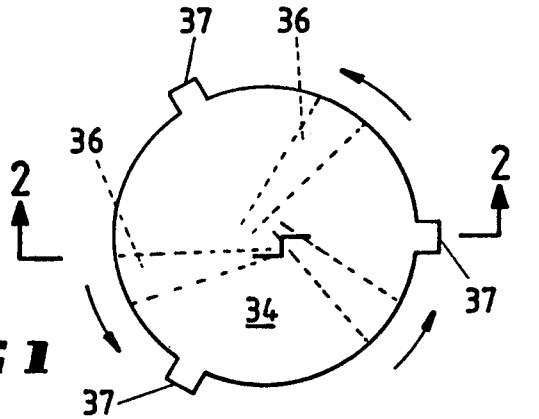
FIG. 1 is a top view of a preferred embodiment of the sprinkler which is useful for watering a large circular area.
Figure 2:
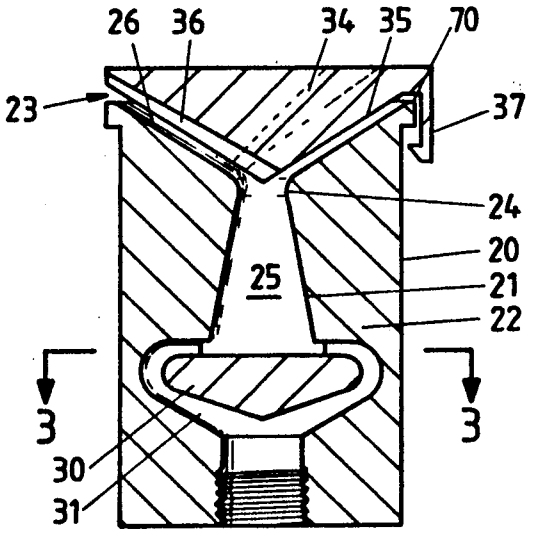
FIG. 2 is a section taken on the stepped section line 2—2 of FIG. 1.

Referring first to the embodiment of FIGS. 1 to 4, a sprinkler comprises a body 20 which contains a smooth annular interior surface 21 which extends from an upstream end 22 of the body to a discharge end 23, the surface 21 including a throat 24 between the ends 22 and 23, there being a generally conical portion 25 of the interior surface 21 upstream of the throat 24 and a generally conical depression 26 which extends from the throat 24 to the discharge end 23.

At the upstream end of the conical portion 25 there is provided an insert 30 which, as shown, has two slots 31 which combine with a surface of the body 20 to allow entry of water below the insert 30 in a generally radial direction but discharge the water into the upstream end of the conical portion 25 as a tangential flow through tangential discharge slot portions 32. In this embodiment it is important to achieve the maximum amount of swirl, and for that reason in some instances it is desirable to use three or four such slots 31 which are equally spaced circumferentially.

The conical depression 26 contains an impeller 34 which has a generally conical surface 35 which is complementary in size and shape to the conical depression 26 and therefore lies in contiguity with it. However, the impeller surface 35 does not extend for the whole of the lower area of the impeller 34 but is interrupted in this embodiment by three discharge channels 36, one of which is shown in detail in FIG. 4, and the discharge channels 36 are located on opposite sides of retaining clips 37, the retaining clips 37 forming no part of this invention but are sometimes used for convenience to prevent inadvertent dislodgement of the impeller 34 from the body 20, for example when the sprinkler is being transported from place to place. They are deformable and make it easy to replace one impeller 34 with another impeller having different characteristics if that is required. Being spaced way from the discharge ends of the channels 36, they do not interfere with operation of the sprinkler, in contrast with some prior art referred to above.

Figure 3:
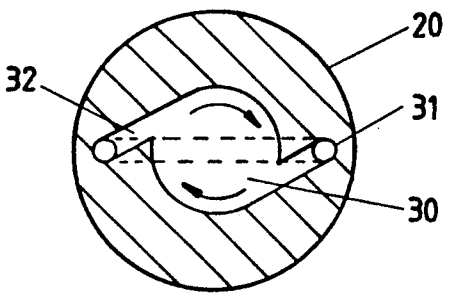
FIG. 3 is a section taken on line 3—3 of FIG. 2.
Figure 4:
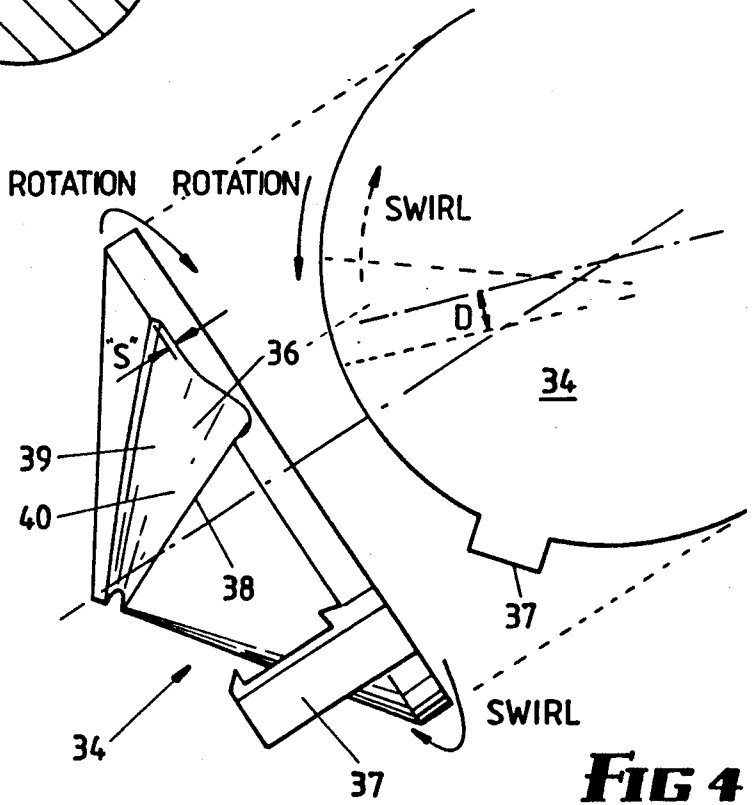
FIG. 4 shows a projection of the impeller illustrated in FIGS. 1 and 2 but drawn to a larger scale, and more specifically illustrates the shape of a discharge channel at its discharge end.

Reference is now made to FIG. 4 wherein the specific shape of a channel 36 is illustrated. The invention is effective with one channel only, but as drawn, channels 36 are located to extend in directions which are not radial but are spaced from respective radial planes by the distance "D", and this imparts a tangential component of the reaction force imparted by water discharging from the channels 36 which causes an anti-clockwise rotational torque (as viewed from above). However, as can be seen in FIG. 3, the swirl which is imparted to water passing through the conical portion 25 and therefore through the throat 24 and the conical depression 26 imparts a clockwise torque to the impeller 34, and these two counter-acting torques can be so adjusted that the impeller rotation is relatively slow (for example about ten revolutions per minute) and this is in turn valuable in achieving maximum throw and maximum coherency of the jets as they are discharged from the channels 36. Surprisingly, rotational speed is almost independent of pressure or flow rate, in contrast with all relevant prior art.

Since the swirl is in this embodiment is clockwise, the trailing surface 38 of channel 36 will intercept and redirect the small quantity of water which will swirl between the impeller 34 and the conical depression 26. The contiguity of the impeller surface 35 with the conical depression 27 is of utmost importance to retain the impeller in position particularly at start-up, but nevertheless it is possible to slightly increase the entry of water into the discharge channels 36 with a small gap formed by a rebated surface 39 which leads the trailing surface 38 at least insofar as the swirl of water is concerned. It is very important however that the rebated surface 39 should be very shallow and is separated from the general conical surface by the small distance "S", which should not exceed one millimetre.

The leading surface 40 of the channel 36 desirably slopes, whereas where the trailing surface 38 cooperates with the surface of the conical depression 26, and is substantially at right angles thereto. The aforesaid cooperation with the conical depression 26 confines the flow of discharging water to a discrete stream.

If the inner ends of the channels 36 are significantly shallower than the outer ends, and if the flow rate increases, the impeller 34 moves further away from the depression 26 under the influence of increased energy, but the increase of water flow between the impeller and body conical surfaces causes reduced pressure in the outer areas of the impeller, which opposes for the lifting force, so that the impeller occupies a stable position. This in turn makes the throw less dependent on flow rates.

Tests have shown that, in contrast to the arrangement disclosed in the Gilad patent, there is actually a positive pressure at the location of the throat 24, and the negative pressure required to retain the impeller 34 in place in its conical depression 26 is developed solely within the depression 26 by the velocity of water therein relative to the surfaces, due to the swirl and also to the rapid rate of discharge of water from the channels 38.

The forces which are relevant are derived from the well known potential fluid flow energy equation:

$$E_p = \frac{P}{Pg} + \frac{V^2}{2g} + Z$$

Wherein:

$E_p$ is the total fluid energy;

P is the pressure;

V is the velocity; and p, g and Z are all constants.

It follows therefore that if there is a high relative velocity of water between the contiguous surfaces of the impeller 34 and the conical depression 26, $V^2$ will be large and if the energy is the same P will be small, and it is this low pressure which retains the impeller in place without any need for any retention means such as the retaining clips 37.

Figure 5:
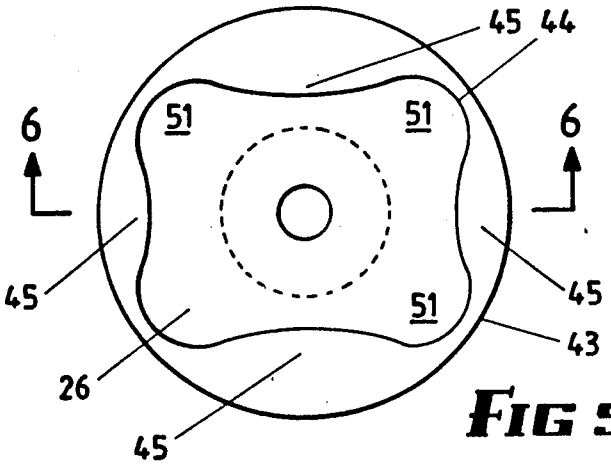
FIG. 5 is a top view of an alternative shape of body which is useful for watering a rectangular area.
Figure 6:
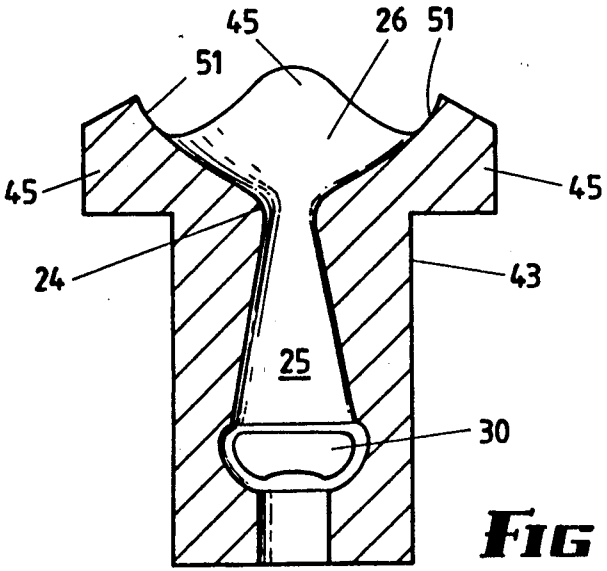
FIG. 6 is a diagrammatic cross-section taken on line 6—6 of FIG. 5.

Reference is now made to the other embodiments which are illustrated:

FIGS. 5 and 6 illustrate a body 43 only of a sprinkler, and the conical depression 26 thereof, terminates in a periphery 44 which is radially beyond the impeller periphery and is not circular although it is associated with a conical impeller surface similar to that shown as the surface 35. This however provides means which deflect the flow upwardly where the lobes 45 exist, each lobe 45 having a concave deflector surface 51, and since these are four in number, a rectangular area will be watered, the upward deflection of water reducing throw. It is noted from FIG. 6 that two of the lobes 45 extend a smaller distance than the other two lobes 45.

Figure 7:
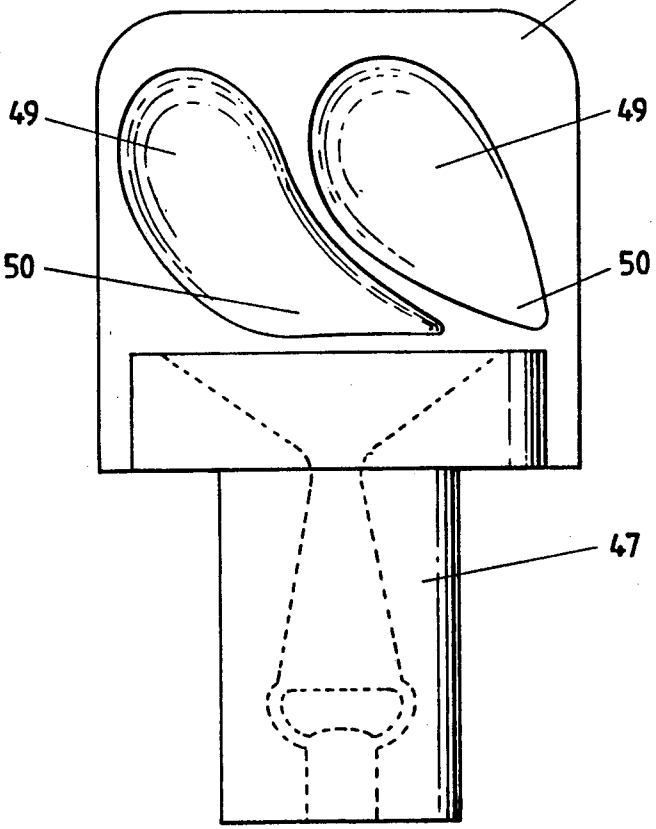
FIG. 7 is a diagrammatic representation of a body and deflector which is useful for watering a semicircular area.

In FIG. 7, the body 47 carries on it a deflector 48 which has two scallop shaped deflector surfaces 49 therein and these receive the transmitted jets of water from the impeller at their lower ends 50 and redirect them upwardly over the impeller so that a half circular area may be watered.

Figure 8:
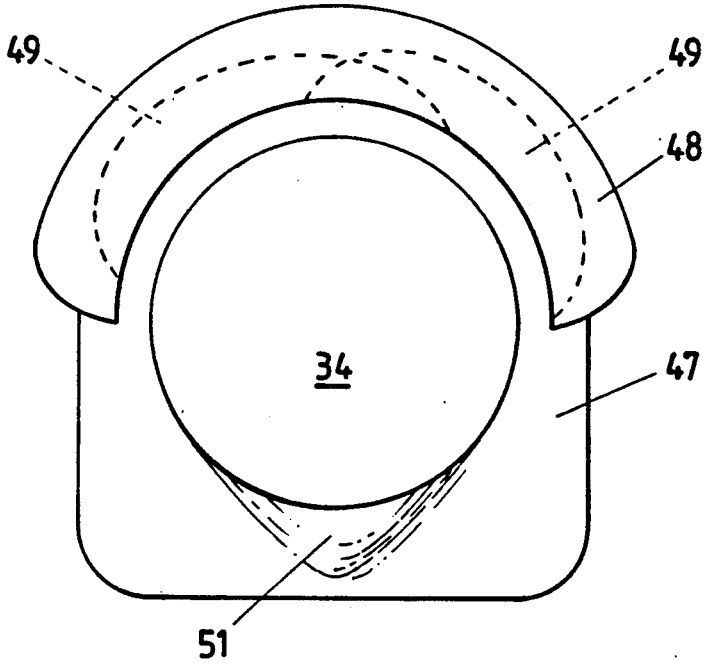
FIG. 8 is a top view of a sprinkler which combines the features of FIGS. 6 and 7, and therefore waters a generally rectangular area from a central location along one side.
Figure 9:
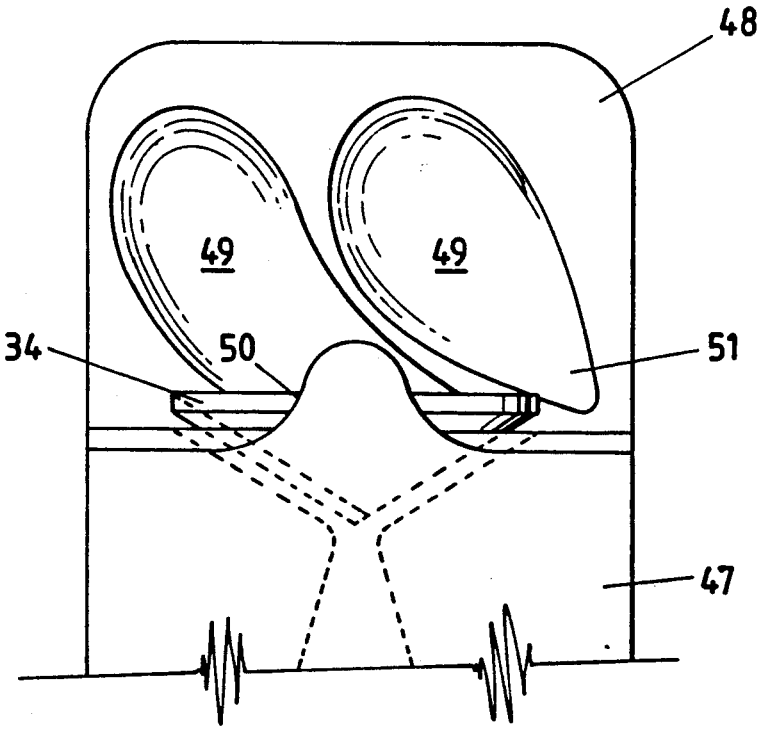
FIG. 9 is a side view of FIG. 8.

FIGS. 8 and 9 illustrate a combination of the deflector surfaces 49 of deflector 48 and a lobe 45 of FIGS. 5 and 6, which, when arranged with the lobe opposite the deflector surfaces as shown, provide a means for watering a rectangular area from one long side, and therefore a sprinkler accordingly to FIGS. 8 and 9 is particularly useful.

Figure 10:
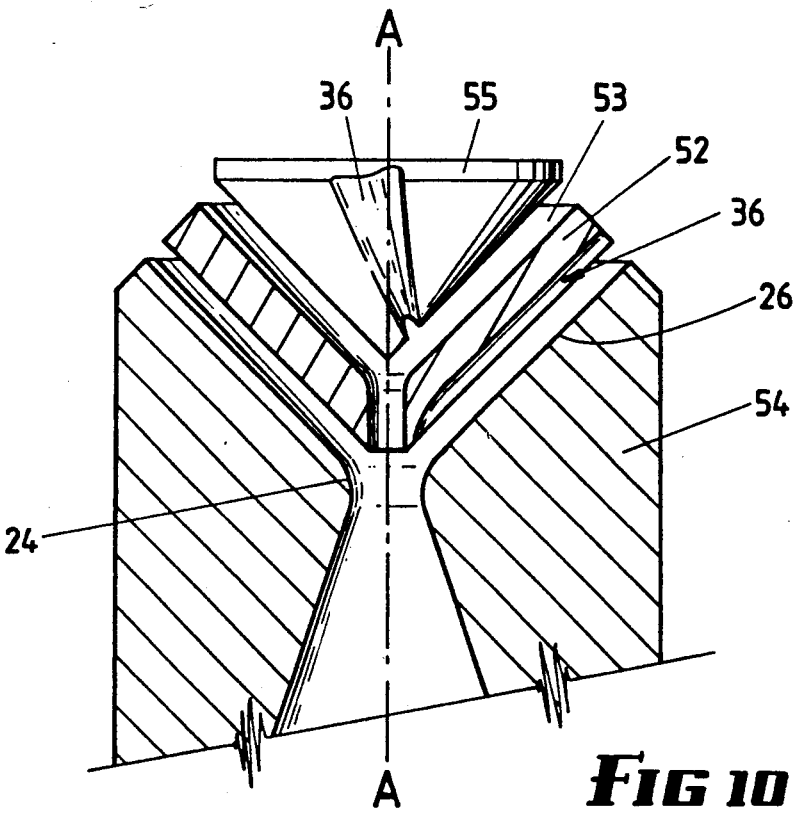
FIG. 10 is a diagrammatic section which shows the use of a main impeller and an ancillary impeller coaxial with the main impeller.

In FIG. 10, the diagrammatic representation illustrates a hollow main impeller 52 which contains an upwardly directed conical depression 53 in addition to the conical depression 26 of the body 54, this in turn contains an ancillary impeller 55 which is also provided with channels 36 as in the other embodiments and is capable of more evenly distributing water over a circular area since the ancillary impeller 55 will discharge water with a shorter throw.

Figure 11:
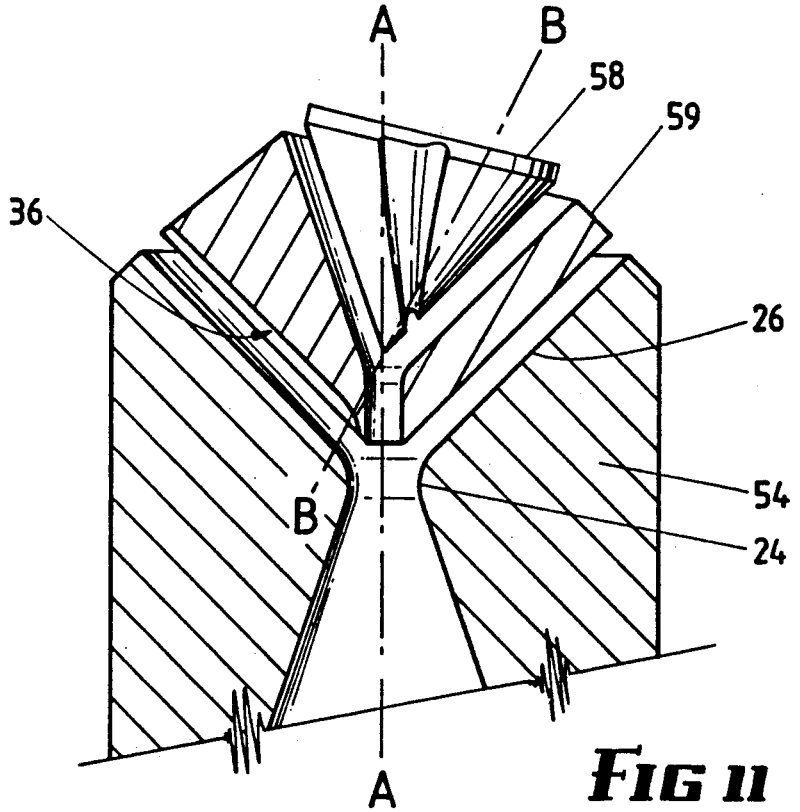
FIG. 11 is a diagrammatic representation similar to FIG. 10 but showing the ancillary impeller rotatable about an axis which is inclined to the axis of rotation of the main impeller.

The embodiment of FIG. 11 also shows a similar arrangement excepting that the ancillary impeller 58 rotates about an axis B—B which is not coaxial with the axis A—A of rotation of the main impeller 59. The body is designated 54, being substantially the same as the body in FIG. 10.

Figure 12:
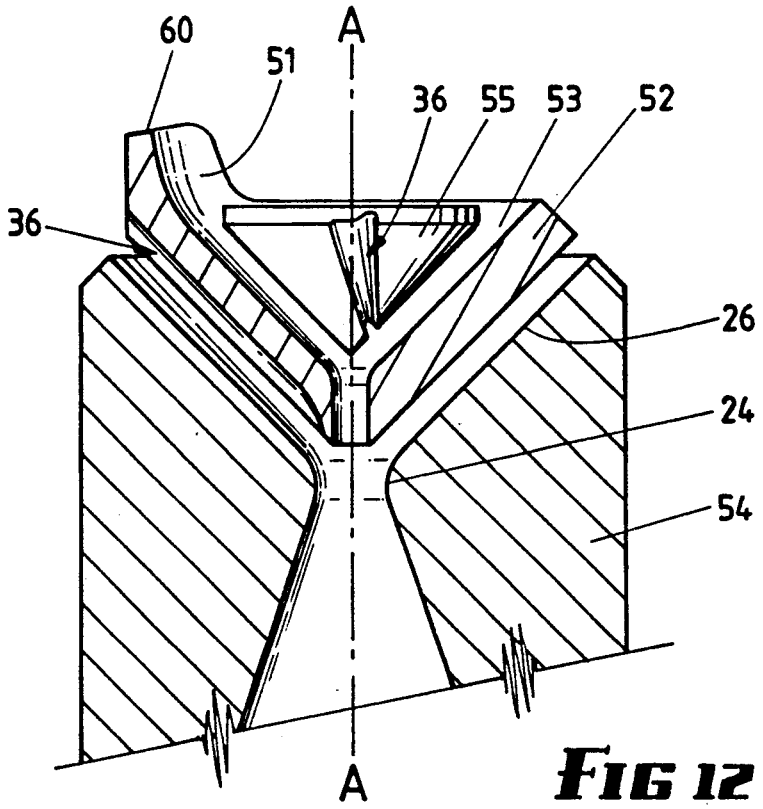
FIG. 12 shows diagrammatically a further arrangement wherein the main impeller of a two impeller sprinkler is used for deflecting throw for some of the rotation of the ancillary impeller.

FIG. 12 also has a body designated 54, and the main impeller 52 is provided with a conical depression 53 which receives an ancillary impeller 55 all this being similar to what is shown in FIG. 10, with the exception however that portion of the main impeller 52 includes a deflector 60 which contains a deflector surface 51 of similar shape to the deflector surfaces 51 in FIGS. 5 and 6, and deflects some of the throw of the ancillary impeller 55.

Figure 13:
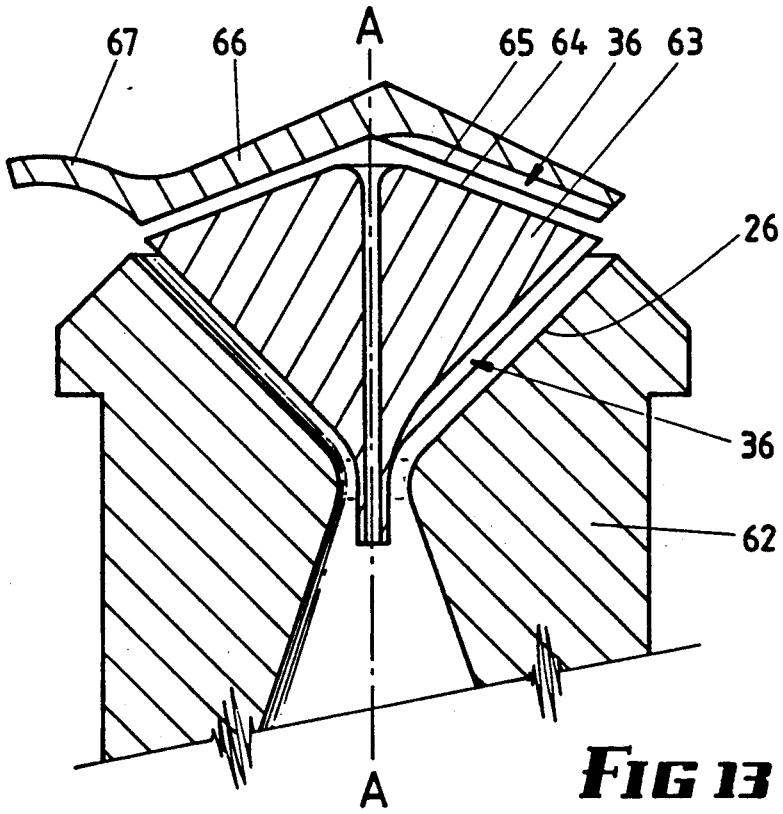
FIG. 13 is a further diagrammatic representation showing an alternative construction wherein a main impeller is surmounted by a hood-like ancillary impeller, the ancillary impeller having a conical depression which is inverted with regard to that shown in FIG. 10, and incorporates a deflecting surface.

In all the other embodiments, as illustrated the conical depressions are directed towards the upstream end of the bodies, but in this last embodiment of FIG. 13, the body 62 also has a conical depression 26 as previously, but the main impeller 63 has an upwardly convex surface 64 and this is contiguous with a downwardly concave complementary surface 65 of the ancillary impeller 66, which rotates over the main impeller 63. The impeller 66 is provided with a deflector 67, which can interrupt the streams from discharge channels 36 of the main impeller 63.

Although the surfaces of the impeller and recesses have been described as generally conical, they can quite clearly be of curved shape, there being some advantages in certain instances of having such a shape. For example, if a low trajectory is required, a curved shape will assist in achieving that. In certain instances, the discharge end 23 illustrated in the first embodiment, includes a small flat land designated 70, and if this is surmounted by an outwardly directed horizontal rim of the impeller 34, which exists on that area of the periphery between the channels 36, then the restraint against rotation which might otherwise occur can be reduced. In that regard it should be noted that although the diameter of the impeller is not critical, the very large diameter will result in a higher pressure urging the conical surfaces towards each other and this can in turn impart constraint to the rotational velocity of an impeller.

The following distinctions are evident with respect to the Gilad U.S. Pat. No. 4,331,294 which is considered by the Applicant to be the most relevant prior art:

1) The Gilad patent recites a low pressure in the vortex chamber, that is upstream of the throat, whereas in all instances, when working, the pressure with this invention is above atmospheric pressure upstream of the throat, and a small aperture drilled centrally through the axis of rotation of the impeller has indicated that a high pressure exists where the water encounters the impeller.
2) The Gilad patent recites impact of the liquid on the spray control body (impeller) produces a droplet spraying effect.

With the sprinkler of this invention however, the low pressure beneath the impeller, and the shapes of the channels 36 result in the low pressure being imparted solely at the locations of contiguous surfaces of the impellers with the Applicant's device, and the discharge is in the form of the coherent jets.

3) The Gilad patent indicates the need for biasing spring in FIG. 26 to retain the impeller in position, but that has been shown to be completely unnecessary with the arrangement of the Applicant's device wherein the contiguous conical surfaces draw and retain the impeller in place once there is a passage of swirling water between those surfaces.
4) Gilad recites that control of droplet size spectrum is a function of the floating spray control body (impeller) being at a close distance from the orifice rim.

The Applicant maintains such a close distance ("S" being the largest distance) that nearly all discharge takes place through the discharge channels and droplets do not normally develop until an undeflected stream has progressed by a distance which exceeds one meter from the nozzle.

5) Experiments conducted with the sawtooth arrangement of the Gilad patent associated with the Applicant's device indicated that such an arrangement will function but will not achieve the long throw large droplet result which is achieved with the Applicant's device wherein the conical surfaces are retained in contiguity.

I claim;

1. A sprinkler useful as an irrigation device comprising a body containing an annular surface extending from an upstream end to a discharge end, including a throat intermediate said ends, a generally conical surface diverging from said throat to said discharge end, and fair surfaces in the region of said throat, swirl imparting surfaces at the upstream end of said generally conical surface, and an impeller in a conical depression having a generally conical surface, diverging in a discharge direction and substantially complementary in shape to said diverging conical surface to said body, so that, in use, most of the impeller surface lies contiguous with said diverging conical body surface, said impeller conical surface containing surfaces defining a plurality of discharge channels extending outwardly from near its center, said discharge channels being of size and shape to be co-operable with said diverging conical body surface to confine water when discharging into respective coherent water jets.

2. A sprinkler according to claim 1 wherein said diverging conical body surface forms said conical depression, the dimensions and shapes of the annular surface, swirl imparting surfaces and discharge channel surfaces being such that, when water passes from said upstream end to said depression, it has sufficient swirl to retain said impeller in contiguity with but freely rotatable with respect to said conical depression surface.

3. A sprinkler according to claim 2 wherein said discharge channels extend in planes from the center of the impeller to its periphery.

4. A sprinkler according to claim 2 wherein said conical depression has a circular periphery which defines said discharge end and results in a circular irrigation pattern.

5. A sprinkler according to claim 2 wherein said conical depression is surrounded by at least one deflecting surface and results in a non-circular irrigation pattern.

6. A sprinkler according to claim 2 further comprising a deflector attached to said body in the path of water discharging from said discharge channels over a portion of the circumference and having a deflector surface of such concave shape as to intercept and redirect water which impinges said deflector surface.

7. A sprinkler according to claim 2 wherein said impeller comprises at least one lip extending part way around its periphery and overhanging a complementary annular surface of said body.

8. A sprinkler according to claim 1 wherein said discharge channels extend generally in a direction displaced from, but generally parallel to respective radial planes from the center of the impeller to its periphery.

9. A sprinkler according to claim 8 wherein said channel surfaces extend in directions which are so displaced from said respective radial planes that water discharging from said discharge channels imparts a torque to said impeller in a rotation direction counter to the direction of swirl imparted by said swirl imparting surfaces.

10. A sprinkler according to claim 1 wherein said impeller is a main impeller and itself contains a second generally conical depression, and further comprises an ancillary impeller in said second generally conical depression, said ancillary impeller also having a generally conical surface substantially complementary in size and shape to said second generally conical depression, and containing surfaces defining a further plurality of discharge channels extending from near its center to its periphery, and further comprising a conduit surface extending through said main impeller providing a central water flow passage through said main impeller to said secondary generally conical depression.

11. A sprinkler according to claim 10 wherein said second generally conical depression and said ancillary impeller are co-axial about an axis of rotation which intercepts, but is not coaxial with the axis of rotation of said main impeller.

12. A sprinkler according to claim 1 wherein the cross-sectional area of each said discharge channel increases towards the periphery of said impeller.

13. A sprinkler according to claim 1 wherein each said channel is shallower at its inner end than at its outer end.

14. A sprinkler useful as an irrigation device comprising a body containing an annular surface extending from an upstream end to a discharge end, including a throat intermediate said ends, a generally conical surface diverging from said throat to said discharge end, and fair surfaces in the region of said throat, swirl imparting surfaces at the upstream end of said generally conical surface, and an impeller in a conical depression having a generally conical surface, diverging in a discharge direction and substantially complementary in shape to said diverging conical surface of said body, so that, in use, most of the impeller surface lies contiguous with said diverging conical body surface, said impeller conical surface containing a surface defining at least one discharge channel extending outwardly from near its center, said at least one discharge channel being of size and shape to be co-operable with said diverging conical body surface to confine water when discharging into a coherent water jet.

* * * * *